US011124273B2

(12) United States Patent
Prevel et al.

(10) Patent No.: US 11,124,273 B2
(45) Date of Patent: Sep. 21, 2021

(54) BUOY

(71) Applicant: THALES, Courbevoie (FR)

(72) Inventors: Florian Prevel, Brest (FR); Romain Careric, Brest (FR)

(73) Assignee: THALES, Courbevoie (FR)

( * ) Notice: Subject to any disclaimer, the term of this patent is extended or adjusted under 35 U.S.C. 154(b) by 140 days.

(21) Appl. No.: 16/605,011

(22) PCT Filed: Apr. 13, 2018

(86) PCT No.: PCT/EP2018/059571
§ 371 (c)(1),
(2) Date: Oct. 13, 2019

(87) PCT Pub. No.: WO2018/189388
PCT Pub. Date: Oct. 18, 2018

(65) Prior Publication Data

US 2020/0180733 A1 Jun. 11, 2020

(30) Foreign Application Priority Data

Apr. 14, 2017 (FR) ..... 1700419

(51) Int. Cl.
*B63B 22/22* (2006.01)
*B63B 22/00* (2006.01)

(52) U.S. Cl.
CPC ..... *B63B 22/22* (2013.01); *B63B 22/003* (2013.01)

(58) Field of Classification Search
CPC ..... B63B 22/00; B63B 22/003; B63B 22/18; B63B 22/20; B63B 22/22; B63B 22/24
USPC .... 441/1, 6, 7, 9, 11, 21, 22–26, 28, 30, 32, 441/33
See application file for complete search history.

(56) References Cited

U.S. PATENT DOCUMENTS

| | | | | |
|---|---|---|---|---|
| 2,687,541 | A | 8/1954 | Bryant | |
| 8,171,873 | B2 | 5/2012 | Woolwright et al. | |
| 10,131,412 | B2 * | 11/2018 | Hulbert | G08B 25/016 |
| 10,583,904 | B2 * | 3/2020 | Hulbert | A61B 5/14551 |

FOREIGN PATENT DOCUMENTS

| | | |
|---|---|---|
| EP | 0 449 371 A1 | 10/1991 |
| FR | 2 350 245 A1 | 12/1977 |
| JP | 9-240579 A | 9/1997 |

* cited by examiner

*Primary Examiner* — Daniel V Venne
(74) *Attorney, Agent, or Firm* — BakerHostetler

(57) ABSTRACT

A buoy includes a surface unit comprising a sealed tank comprising an inflatable bag, a tubular wall of axis z and a bottom, the tubular wall and the bottom delimiting a volume referred to as the inner volume, the surface unit comprising at least one cartridge enclosing a compressed gas that can be released in such a way as to inflate the inflatable bag such that it functions as a float in an operational configuration of the buoy, and the sealed tank comprises a projecting container protruding from the bottom and extending out from the inner volume, from the bottom.

16 Claims, 4 Drawing Sheets

BUOY

CROSS-REFERENCE TO RELATED APPLICATIONS

This application is a National Stage of International patent application PCT/EP2018/059571, filed on Apr. 13, 2018, which claims priority to foreign French patent application No. FR 1700419, filed on Apr. 14, 2017, the disclosures of which are incorporated by reference in their entirety.

FIELD OF THE INVENTION

The present invention relates to buoys of the type comprising an inflatable bag and at least one cartridge enclosing a compressed gas that can be released such as to inflate the inflatable bag using the gas so that the inflated bag functions as a float.

The present invention relates notably to communication buoys of the type comprising at least one radioelectric antenna designed to be arranged above the surface of the water in order to allow communication with a remote base. The inflatable bag is equipped with a radioelectric antenna arranged such that, when the bag is inflated using the gas, the bag resurfaces such as to bring and to maintain the radioelectric antenna above the surface of the water. In a variant, the buoy may serve as a reference point or for maintaining an object immersed at a predetermined level.

BACKGROUND

These buoys may be deployed from a carrier located above the surface of the water or from a submarine.

These buoys generally comprise a stack of coaxial cylinders housing functional elements of the buoy. This stack is housed in a tubular receptacle prior to deployment of the buoy.

The size of the cylinders and of the internal equipment is greatly constrained by the size of the tubular receptacle.

Buoys conventionally comprise a surface unit comprising a sealed tank comprising the inflatable bag and a cylindrical casing forming one of the cylinders of the stack. The casing houses electrical equipment, including one or more electric circuits for processing signals originating from and/or destined for a radioelectric antenna and/or at least one battery for powering these electric circuits and/or the antenna.

The surface unit rises to the surface of the water when the inflatable bag is inflated, while the depth unit generally descends to a depth, for example to emit and/or to receive sound waves.

With a view to guaranteeing good radioelectric communication or enabling the buoy to be clearly seen even when the sea is rough, the inflatable bag must be able to reach a sufficient height above the level of the sea, which presupposes satisfactory inflation of the inflatable bag.

To that end, prior-art deployable buoys comprise a plurality of cartridges of similar volume enclosed inside the casing. These cartridges are arranged such that their longitudinal axes are perpendicular to the axis of the cylinder formed by the casing. The inner volume of the casing communicates with the inner volume of the inflatable bag. However, the size of the casing is increased fairly significantly for each added cartridge, this volume being greater than the volume of the cartridge and thereby leading to a fairly significant increase in the drag of the casing. In point of fact, the drag of the casing must generally be minimized in order thus to guarantee the positional stability of the surface unit by limiting the movements of the depth unit through the effect of antagonistic currents at the surface and at depth.

The same problems are encountered when it is desired to multiply or to increase the size of the equipment housed in the casing.

SUMMARY OF THE INVENTION

An object of the invention is to limit at least one of the aforesaid drawbacks.

To that end, a subject of the invention is a surface unit comprising a sealed tank comprising an inflatable bag, a tubular wall of axis z and a bottom, the tubular wall and the bottom delimiting a volume referred to as the inner volume, the surface unit comprising at least one cartridge enclosing a compressed gas that can be released in such a way as to inflate the inflatable bag such that it functions as a float in an operational configuration of the buoy. The sealed tank comprises a projecting container protruding from the bottom and extending away from the inner volume, from the bottom.

Advantageously, the buoy comprises one or more features, taken alone or in combination:

a larger dimension of the projecting container perpendicularly to the axis z being less than a smaller dimension of the tubular wall perpendicularly to the axis z, the buoy is configured such that a front surface of a submerged part of the surface unit or of the sealed tank, when the buoy is in the operational configuration, comprises a part of the projecting container, the buoy is configured such that a front surface of a submerged part of the surface unit or of the sealed tank, when the buoy is in the operational configuration, comprises a part of the tubular wall, the buoy comprises at least one element of the buoy arranged in a volume surrounding the projecting container when the buoy is in a storage configuration in which the gas is confined in the cartridge, said at least one element and the surface unit are inserted in one and the same receptacle when the buoy is in the storage configuration, the buoy comprises a depth unit connected to the surface unit by a cable, the depth unit and the surface unit being connected, when the buoy is in a storage configuration in which the gas is confined in the cartridge, and separated when the buoy is in the operational configuration, at least one of said at least one element forms part of the depth unit, at least one of said at least one element is an active functional element, at least one element comprises a tubular container surrounding the projecting container, at least one element comprises a cable winding, the buoy comprises a single cartridge, the cartridge is arranged such that the gas is expelled from the cartridge upward, when it is released, the projecting container is a part of the cartridge, the buoy is arranged such that the cartridge comes into direct physical contact with the water when the buoy is submerged in the water, the inner volume receives at least one electronic circuit and/or at least one electrical energy accumulator and/or a system for releasing the gas, the projecting container delimits a volume communicating with the inner volume when the buoy is in a storage configuration in which the gas is confined in the cartridge, the projecting container receives a part of at least one electronic circuit and/or of at least one electrical energy accumulator and/or of at least one system for releasing the buoy and/or the gas cartridge, the buoy comprises a radioelectric antenna, the antenna being arranged such that the antenna is brought above the surface of the water when the bag functions as a float.

BRIEF DESCRIPTION OF THE DRAWINGS

The invention will be better understood by studying a number of embodiments described by way of examples that are in no way limiting and are illustrated by appended drawings, in which:

The same elements from one figure to another are denoted by the same numerical references.

FIGS. 1*a*, 1 *b*, 1*c*, 1*d* illustrate the deployment of a buoy according to the invention.

DETAILED DESCRIPTION

In the non-limiting example of FIGS. 1*a* to 1*d*, the buoy 1 is a buoy that can be deployed from a carrier 100 located above the surface of the water. This carrier 100 is, for example, an aircraft, a helicopter or a surface structure. In a variant, the buoy is connected to a submarine and is designed to provide radioelectric communication between the submarine and a station located above sea level.

Figure 1A:
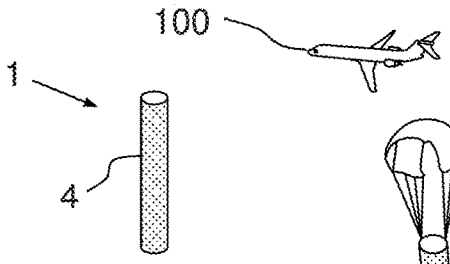
FIGS. 1*a* to 1*d* show successive phases of deployment of a deployable buoy, deployed from an aircraft, FIG. 2 schematically shows in perspective a surface unit according to the invention in the storage configuration, FIG. 3 schematically illustrates in cross section, on a longitudinal axis, a part of the buoy according to the invention, FIG. 4 schematically illustrates the buoy in an operational configuration, FIG. 5 very schematically illustrates another example of a casing according to the invention.

The buoy 1 may comprise, as shown in FIGS. 1*a* to 1*d*, a tubular receptacle 4 delimiting an inner volume of globally cylindrical form that has negative buoyancy and within which is housed a part, called the internal part, of the buoy in a storage configuration of the buoy shown in FIG. 1*a*. When the buoy 1 is in a storage configuration, the inflatable bag 3 is not inflated.

The inner volume is advantageously but not necessarily an axisymmetrical volume.

Figure 1B:
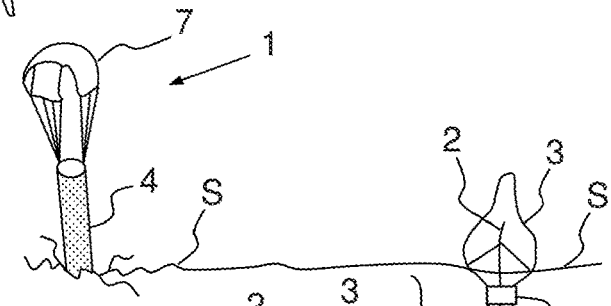

When the buoy is deployed from an aircraft 100, as shown in FIG. 1*b*, a parachute 7 is deployed outside the receptacle 4 such as to slow down the fall of the buoy 1 into the water.

Figure 1C:
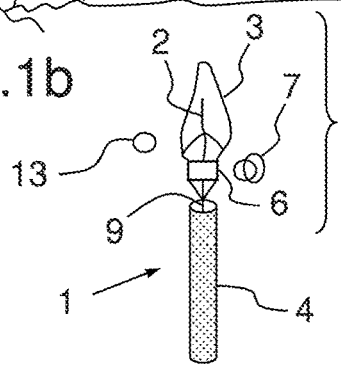
Figure 1D:
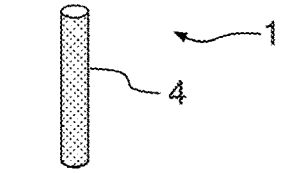

Once the buoy is submerged in the water, as shown in FIG. 1*c*, the inflatable bag 3 inflates, which has the effect of ensuring the detachment of the parachute 7, and of causing the emergence of a casing 6 from the surface unit 5 of the receptacle 4, and the rising of the surface unit 5 toward the surface S of the water, as shown in FIG. 1*c*, such as to bring the float 3 of the surface unit 5 to the surface of the water.

The internal part of the antenna comprises a stack of several units. This stack comprises the surface unit 5 and a depth unit 8 with negative buoyancy. The surface unit 5 and the depth unit 8 are connected when the antenna is in the storage configuration of FIG. 1*a*. These elements are conventionally housed in the tubular receptacle of generally standard size prior to deployment of the buoy, i.e. when the buoy is in the storage configuration. The volume attributed to each unit is very restricted and it is essential to limit the volume occupied by the various elements within the tube.

The surface unit 5 is connected to a depth unit 8 by a cable 9 that unwinds upon inflation of the inflatable bag 3 such that the surface unit 5 rises toward the surface S while the depth unit 8 continues its descent toward the sea bed. When the surface unit 5 rises toward the surface S, the depth unit 8 continues to sink and thus separates from the surface unit 5. The cable 9 is deployed or unwound during this phase until the depth unit 8 reaches a predetermined depth. The descent of the depth unit 8 is halted by stopping the unwinding of the cable 9. The cable 9 is then under tension. The receptacle 4 with negative buoyancy continues to sink, thereby releasing the depth unit 8. The antenna 1 is then in an operational configuration, shown in FIG. 1*d*.

In the operational configuration, the inflatable bag 3 is supported by a casing 6 of the surface unit 5. A part of the surface unit 5 is submerged in the water when the buoy is in the operational configuration.

The buoy 1 is, for example, but not necessarily, a communication buoy of the type comprising at least one radioelectric antenna 2 for emitting and/or receiving radioelectric waves. In this case, the buoy 1 is configured such that the radioelectric antenna 2 is maintained above the surface of the water when the buoy 1 is in the operational configuration so as to allow radioelectric communication of information between the buoy 1 and a remote station located above the level of the sea, for example on board the carrier 100, when the antenna is located above the surface of the water.

The buoy 1 comprises, for example, one or more sensors that make it possible to measure a physical value, the buoy being configured such that the sensor is submerged in the water when the buoy 1 is in the operational configuration.

The buoy comprises, for example, one or more designed to measure underwater sound waves and/or one or more temperature sensors designed to be submerged in order to measure a temperature of the water.

A buoy comprising one or more hydrophones is an acoustic buoy, also known as a "sonobuoy" in English.

The buoy is, for example, designed to radioelectrically transmit, by means of the radioelectric antenna, information on the underwater sound waves detected by at least one hydrophone.

In a variant, or in addition to the one or more sensors, the buoy 1 comprises at least one sound wave emission antenna. The buoy is then said to be "active".

At least one hydrophone advantageously belongs to the depth unit when the buoy comprises a surface unit and a depth unit.

Figure 2:
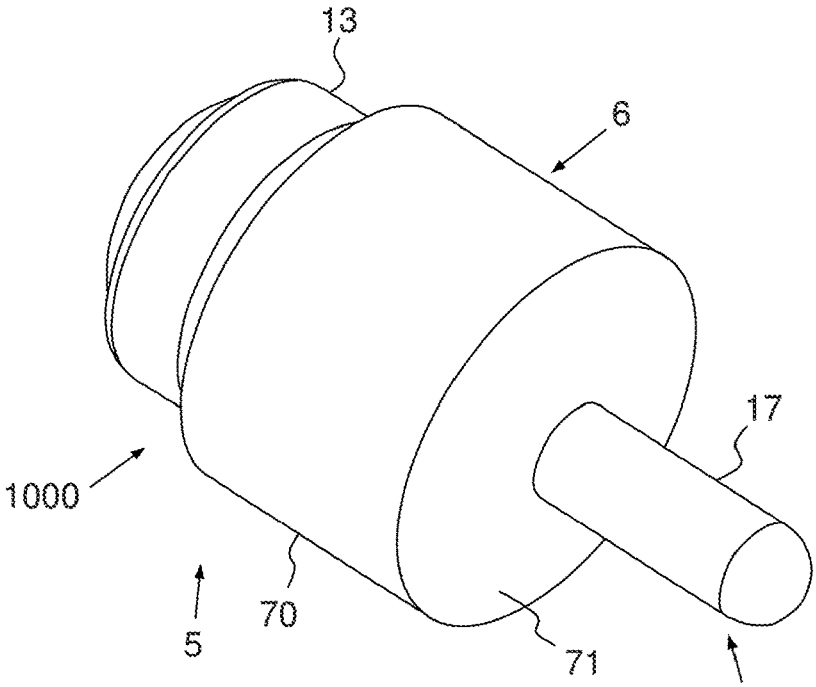
Figure 3:
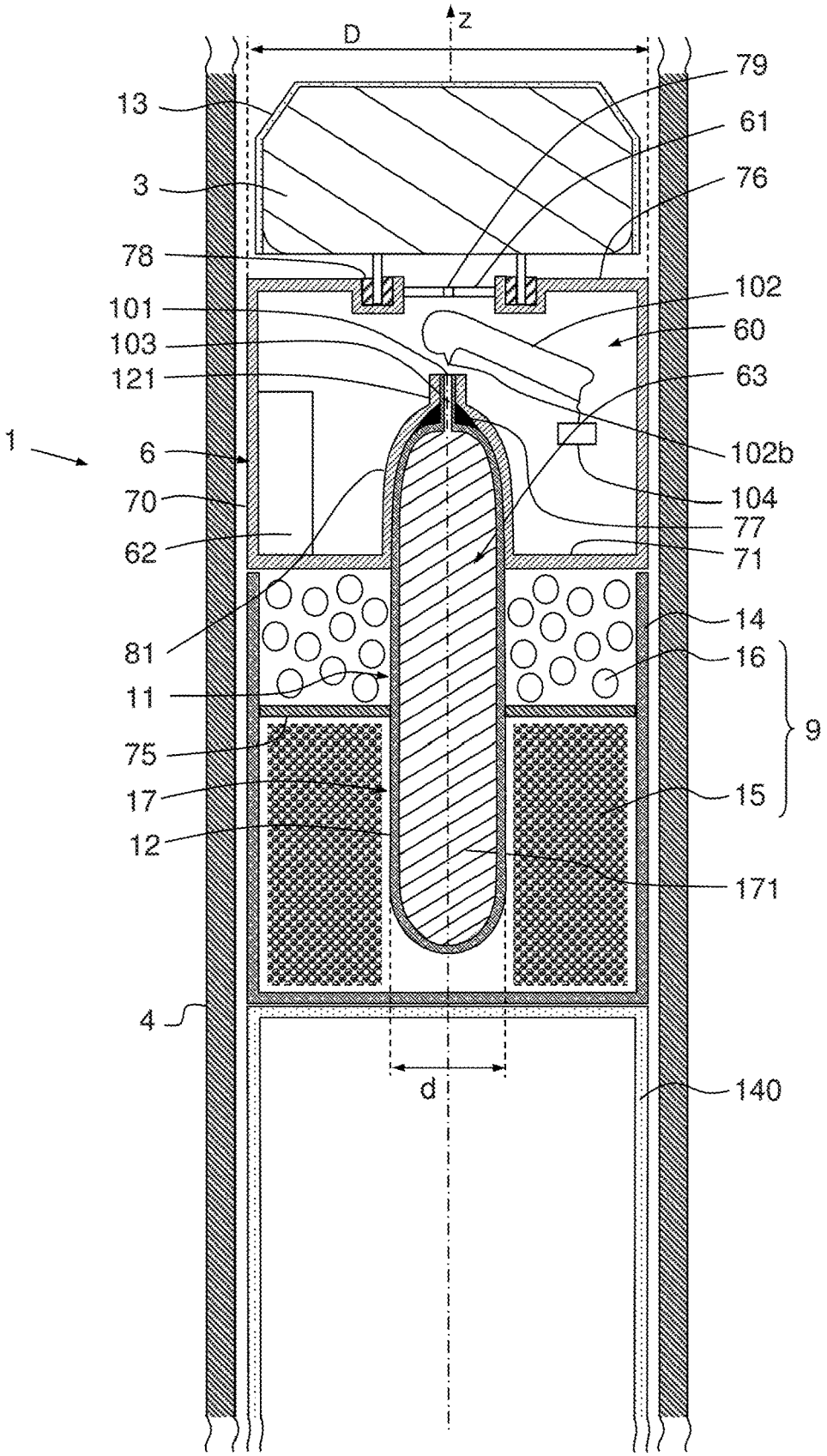

FIG. 2 illustrates a perspective view of principal elements of the surface unit 5 of the buoy 1 according to the invention when the buoy is in the storage configuration. In FIG. 3, the inflatable bag is protected by a cap 13. FIG. 3 shows a cross-sectional view of the buoy according to the invention in the storage configuration.

The surface unit 5 comprises a gas cartridge 11 enclosing a compressed gas.

This gas is, for example, air, carbon dioxide or nitrogen dioxide.

The gas confined in the cartridge can be released. In other words, it may be released from the cartridge 11.

In the storage configuration of the buoy, shown in FIGS. 2 and 3, the gas is confined in the cartridge 11, which is sealed. In other words, the inflatable bag 3 is not inflated. In the operational configuration of the buoy 1, the inflatable bag 3 is inflated using the gas that was confined in the cartridge 11 in the storage configuration, and the inflatable bag 3 then functions as a float.

The gas contained in the cartridge can be released by means of a gas release system that will be described below. The gas release system is capable of forming an orifice in the cartridge in order to release the gas.

The cartridge 11 and the inflatable bag 3 are arranged such that, when the gas is released, the gas contained in the cartridge 11 inflates the inflatable bag 3 so that the bag 3 becomes a float. In other words, the inflatable bag 3 is connected to the cartridge 11 in a gas-tight manner and the inner volume of the cartridge is in communication with the inner volume of the inflatable bag 3 when the gas is released.

The casing 6 is, for example, produced from lightweight, inexpensive and possibly transparent plastics, but it may be produced from any other material.

Advantageously, the casing 6 does not substantially deform when the buoy passes from the storage configuration to the operational configuration.

The casing 6 delimits an inner volume 60.

The surface unit 5 comprises a sealed tank 1000. The sealed tank 1000 comprises the inflatable bag 3 and a casing 6. The inner volume 60 delimited by the casing 6 forms part of the volume delimited by the sealed tank 1000.

As shown in FIGS. 2 and 3, the casing 6 comprises a tubular lateral wall 70 of axis z and a bottom 71 transverse to the lateral wall 70. The lateral wall 70 and the bottom 71 delimit an inner volume 60 of the casing 6 belonging to the inner volume delimited by the tank 1000. In other words, the inner volume 60 extends from one side only of the bottom 71 on the axis z.

Advantageously, but not necessarily, the tubular wall 70 is cylindrical.

Advantageously, but not necessarily, the cylinder is axisymmetrical. In other words, it has a circular cross section.

The cylinder form is advantageously a form of the external face of the tubular wall, i.e. of the face turned toward the exterior of the inner volume 60.

Advantageously, the bottom 71 comprises an external face, i.e. opposite the inner volume 60 extending principally perpendicularly to the axis z.

In the non-limiting embodiment of the figures, the volume is delimited by another wall 76 transverse to the wall 70.

Advantageously, the transverse wall 76 comprises an external face, i.e. opposite the inner volume 60 extending principally perpendicularly to the axis z.

The inner volume 60 is delimited by the walls 70, 71, 76.

In the non-limiting embodiment of the figures, the casing 6 is globally cylindrical.

The inflatable bag 3 is affixed in a sealed manner to the casing 6, for example by means of at least one seal 78, and such that the volume delimited by the casing is in communication with the inner volume delimited by the inflatable bag.

It is possible to house equipment that has to be protected from the water in the sealed tank 1000.

Advantageously, at least one electronic circuit 61 and/or at least one energy accumulator 62 and/or at least one system 102, 104 for releasing a gas is housed in the sealed tank 1000, for example in an inner volume 60 delimited by the casing 6. An electronic circuit is, for example, embodied in the form of an electronic card.

These elements may comprise at least one electronic circuit 61 (for example, embodied in the form of an electronic card) allowing the processing of information originating from and/or destined for the hydrophones or, more generally, sensors located in the depth unit 8, and/or allowing the processing of information destined for and/or originating from the radioelectric antenna.

The energy accumulator is, for example, designed to provide electric power to the electronic circuit(s) and/or the radioelectric antenna and/or a device for actuating a gas release system to be described below.

According to the invention, the sealed tank 1000 comprises a container, referred to as a projecting container, 17 protruding from the bottom 71 and extending away from the inner volume 60, from the bottom 71.

In other words, the projecting container 17 extends from that side of the bottom that is opposite the inner volume 60.

This configuration makes it possible to house supplementary elements in the sealed enclosure without increasing the height of the cylindrical casing 6, which makes it possible to limit the drag thereof and is beneficial in terms of optimizing the occupation of the volume inside the tubular receptacle 4. Indeed, it is possible to house equipment other than those items that have to be housed in the sealed enclosure, around the projecting container 17, and thereby to optimize the occupation of the volume delimited by the receptacle 4, as will be seen below.

This configuration makes it possible to limit the size of the front surface of the submerged part (the part in the water) of the sealed tank 1000 or of the surface unit 5, and thus their drag, while the buoy is in the operational configuration, when a front surface of a submerged part (a part in the water) of the sealed tank or of the surface unit comprises a part of the projecting container and a part of the tubular lateral wall 70. When an object is submerged in a liquid, the term "front surface" of this object is applied to the surface projected in accordance with the trajectory of the liquid over a plane perpendicular to this trajectory. In other words, it is the surface that the object presents to the water. In the present case, the axis z is substantially vertical in the operational configuration. The sea currents are globally perpendicular to the axis z.

For example, it is possible to make provision for a cartridge containing 38 g of $CO_2$, with a casing having a cylindrical part 10 cm in height on the axis z and 17 cm in diameter perpendicularly to the axis z and a cartridge forming a protuberance 10 cm in height on the axis z and 3 cm in diameter perpendicular to the axis z. By providing two cartridges each containing 16 g of $CO_2$ and thus 32 g of $CO_2$ in total, it is necessary to provide a casing 13 cm in height and 17 cm in diameter, which represents a larger front surface.

In the non-limiting example of the figures, the wall 70 and the projecting container 17 are submerged in the operational configuration.

Advantageously, a larger dimension d of the projecting container 17 perpendicularly to the axis z being less than a smaller dimension D of the tubular wall 70 perpendicularly to the axis z. This makes it possible to limit the size of the front surface formed by the casing and the projecting container.

Advantageously, the casing is completely submerged in the operational configuration.

In the non-limiting example of FIG. 3, this projecting container 17 is a part of the cartridge 11 called the "projecting part" of the cartridge.

Thus, the cartridge 11 is at least in part located outside the inner volume 60.

In other words, the cartridge 11 comprises a projecting part 17 extending in the continuation of the cylinder formed by the wall 70 and the bottom 71, on the axis of the cylinder in the case of a cylinder.

The sealed tank 1000 comprises a sealed wall turned toward the exterior of the tank comprising a wall 12 of the cartridge 11. In other words, the cartridge 11 is involved in the closure of the sealed volume delimited by the tank 1000. This makes it possible to avoid isolating the cartridge from the water, notably by the casing 6 (which is very advantageous when the casing is made from plastics) and the air contained in the inner volume of the casing.

The invention makes it possible to free up a space inside the casing 6 and thus to reduce the volume of the casing 6 as compared to a configuration in which the cartridge is housed entirely in the casing 6 of substantially cylindrical form. It also makes it possible to provide a cartridge 11 of greater volume than that of cartridges arranged in the casing without increasing the volume of the casing 6, since the size of the cartridges is no longer limited by that of the casing. For one and the same volume of gas stored in the cartridges, this makes it possible to reduce the number of cartridges used without increasing the size of the casing.

This configuration makes it possible to bring the radio-electric antenna 2 to a greater altitude above the level of the sea and thereby to ensure better performance levels in terms of communication, even when the sea is rough, or, alternately, to make provision for sonar emission antennae and/or hydrophones offering better acoustic performance levels and thus greater mass, without reducing the altitude of the antenna above the level of the water.

This configuration also makes it possible to reduce the total volume occupied by the surface unit 5 for one and the same quantity of gas and thereby to reduce its drag. Indeed, owing to a free volume left between the elements, the volume by which the volume of the casing has to be increased in order to house a gas cartridge is greater than the volume of the cartridge. The limitation on the drag of the surface unit makes it possible to limit the antagonistic drift of the surface unit and of the depth unit through the effect of antagonistic currents (at the surface and at the level of the depth unit 8), which allows stabilization of the depth unit 8.

When the buoy 1 is submerged in the water, water comes into direct contact with the cartridge 11, whereas in the prior art the cartridges housed in the casing are thermally insulated from the water by the casing and by the air contained in the casing. Thus, when the gas is released from the cartridge, the gas cartridge being directly in physical contact with the water, the drop in the temperature of the gas is limited, which limits the likelihood of condensation and of freezing of the gas and the consequences thereof described previously.

Indeed, upon the release of the gas to inflate the inflatable bag, the gas, hitherto contained in the cartridge, expands rapidly, which leads to a reduction in its temperature and of that of the wall of the cartridge, giving rise to condensation of the water vapor from the air contained in the casing, which may thus damage an electronic circuit housed in the casing. The drop in the temperature of the gas may also give rise to the freezing of this gas, which may then block, at least partially, an orifice for the discharge of the gas from the cartridge, thereby delaying, until the temperature has risen sufficiently to vaporize the gas, the inflation of the inflatable bag and the arrival of the inflatable bag at the surface of the water. Lastly, the drop in the temperature of the gas gives rise to a reduction in its volume, which also delays this arrival at the surface. The greater the drop in temperature and the longer the period of time taken by the gas to attain its maximum expansion volume since the gas has to return to ambient temperature in order to attain this maximum expansion volume. Thus, the proposed configuration makes it possible to accelerate the inflation of the inflatable bag and to limit the likelihood of damage to electrical equipment arranged in the casing.

Thus, the gas confined in the cartridge 11 is to be kept apart from the water by a single wall 12, which is a wall of the cartridge 11. In other words, a face of the wall 12 is turned toward a permeable volume. In other words, the cartridge 11 is not completely surrounded by a sealed tank when the buoy is submerged in the water.

Advantageously, the wall 12 is metallic. It is, for example, made from steel in order to withstand significant pressures.

Advantageously, the cartridge 11 is arranged such as to come into direct physical contact with the water when it is submerged in the water, in the storage configuration. Thus, the thermal exchange between the cartridge 11 and the water occurs when the release of the gas commences.

Advantageously, when the buoy 1 is in the storage configuration the cartridge 11 is surrounded by a permeable tank allowing the water to come into direct contact with the cartridge 11 when the cartridge 11 is submerged. In other words, the tank delimits a volume, receiving the cartridge 11, which is not closed in a sealed manner.

In the non-limiting example of FIG. 3, the cartridge 11 is surrounded by a receptacle 14, referred to as the "cable container", delimiting a volume housing the cable 9 in the stored position. This cable container 14 is arranged in the receptacle 4. The tank surrounding the cartridge 11 is permeable. Indeed, at least one of the ends of the receptacle 4 is open such as to enable the internal part of the buoy 1 to emerge from the receptacle 4. Furthermore, the cable container 14 delimits a volume receiving the cartridge 11, and this volume is not closed in a sealed manner. It is not, for example, connected in a sealed manner to the casing 6 and/or to the receptacle 4. In this way, water penetrates inside the receptacle 4 and the cable container 14 such that the water comes into direct physical contact with the cartridge 11. In other words, the water is contiguous with the wall 12.

As may be seen in FIG. 3, the casing 6 comprises an opening 63 formed in the bottom 71. This opening 63 is traversed by the cartridge 11.

The casing 6 is in part closed by the cartridge 11 when the buoy 1 is in the storage configuration. This makes it possible to avoid insulating the cartridge from the exterior environment by means of the casing 6 (which is very advantageous when the casing is made from plastics) and the air contained in the inner volume of the casing.

The cartridge 11 is affixed to the casing 6 in a sealed manner, for example by means of at least one seal 77.

Advantageously, but not necessarily, the casing 6 comprises a return 81 having a form that substantially complements that of the cartridge 11 and is affixed to the cartridge 11 in a sealed manner, for example by means of a seal 77. This promotes the sealing of the connection between the cartridge and the casing.

Figure 5:
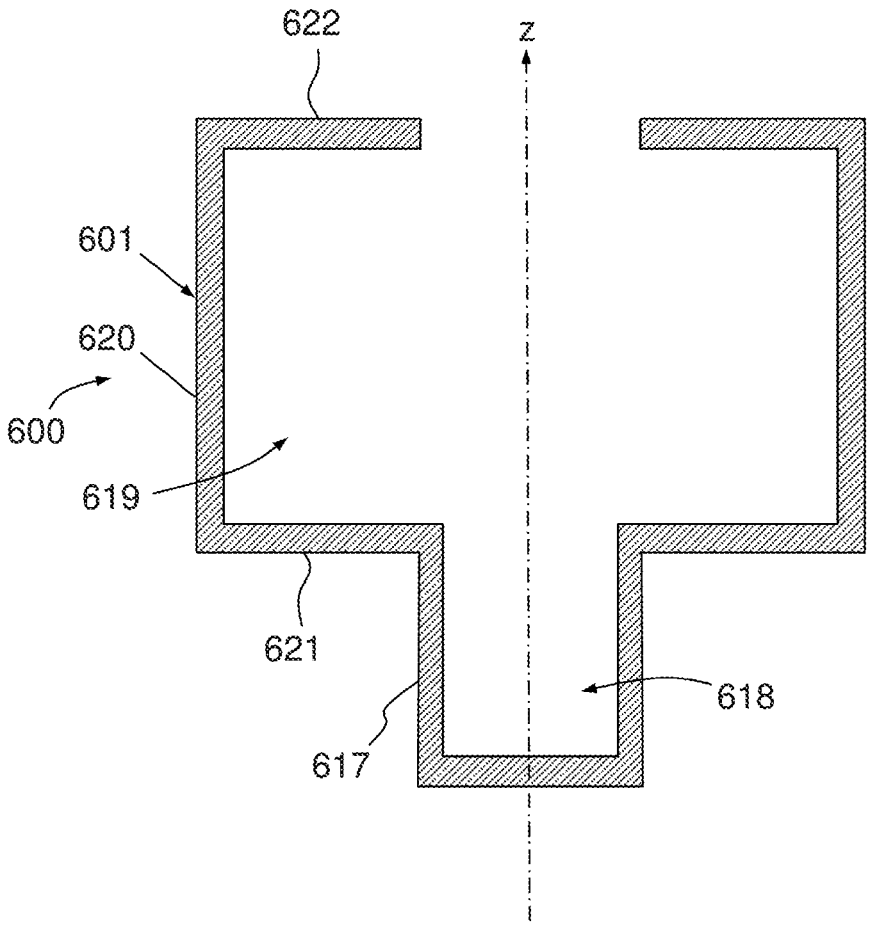

In a variant shown in FIG. 5, the casing 600 comprises a cylindrical part 601 and a protuberance 617 forming the protruding container. This protruding container is made as a single piece with the cylindrical part of the casing 6. In a variant, it is affixed to the casing. This protuberance 617 delimits an inner volume 618 that is in communication with the inner volume 619 delimited by the cylindrical part 601 when the buoy is in the storage configuration and in the operational configuration.

The cylindrical part is delimited by a tubular wall 620 and two transverse walls 621, 622, including the bottom 621 from which the protuberance forms a projection extending away from the inner volume 619, from the bottom 621, on the axis z.

It is, for example, possible to house, in this part, at least a part of one of the items of equipment housed in the sealed enclosure. It is, for example, possible to house therein a part of an electronic card and/or at least a part of a cartridge and/or at least a part of an electronic circuit and/or at least a part of an electrical battery and/or at least a part of a gas release system of the cartridge. This makes it possible to free up slightly the space delimited by the cylindrical part 601, without increasing the height thereof.

The cartridge 11 is, for example, entirely housed in the volume delimited by the sealed enclosure. In other words, the cartridge 11 is fully surrounded by the sealed enclosure.

According to a non-limiting embodiment, the inflatable bag 3 extends on one side of the casing 6 on the axis z and the projecting container 17 extends on the other side of the casing relative to the inflatable bag on the axis z. In other words, the projecting container 17 extends away from the inflatable bag 3 from the bottom 71. According to the non-limiting embodiment of the figures, the inner volume of the cartridge 11 is in communication, when the gas is released, with the inner volume of the inflatable bag 3 via the casing 6. In a variant, the cartridge 11 is arranged such that the gas is expelled directly into the inner volume of the inflatable bag 3. These two cases can be envisaged when the cartridge 11 is fully delimited by the sealed enclosure.

Communication between the inner volume of the inflatable bag 3 and the inner volume of the casing 6 is, for example, achieved via at least one orifice 79.

The orifice 79 is, here, provided in an electronic card 61 closing an opening provided in the casing 6.

The buoy 1 comprises a system for releasing the gas contained in the cartridge. This release system is, for example, a system of perforation of the cartridge 11. The cartridge 11 comprises, for example, a film 101, visible in FIG. 3, that closes an opening 103 made in the cartridge 11 and, more particularly, in the wall 12. The release system comprises a perforator 102 provided with a point 102*b*. The release system comprises an actuating device 104 configured such as to actuate the perforator 102 so that the point 102*b* perforates the film 101 such as to form an orifice in the cartridge 11 (by opening at least a part of the opening), when a gas release status is verified. The actuating device 104 comprises, for example, a resistor and a source of electrical power to the resistor. The actuating device 104 is configured such as to supply electricity to the resistor when the gas release status is verified in such a manner as to release the perforator 102 so that it perforates the film 101. The perforator 102 is, for example, a lever held in a standby position, as shown in FIG. 3, by a thread that is burned by the resistor which heats up when it is powered such that the lever rocks in order to perforate the film 101. This actuating system is in no way limiting. In a variant, the release system comprises, for example, an actuating device of the pyrotechnic or hydrostatic type.

Advantageously, as shown in FIG. 3, the gas release system 102, 104 is housed in the sealed enclosure, for example in the inner volume 60. In a variant, the gas release system is housed in the projecting container 17.

Advantageously, the buoy 1 comprises a single cartridge 11 of gas that can be released such as to inflate the inflatable bag 3. This makes it possible to reduce the drag of the surface unit 5 and to limit the complexity and the number of release devices. Furthermore, the free space in the casing 6 being greater than when the cartridges 11 are housed in the casing 6, only one lever is needed to release the gas and there is no need to provide a return cam in order to limit the volume occupied by the actuating device 104.

In a variant, the buoy 1 comprises several cartridges of gas that can be released in order to inflate the inflatable bag 3.

Advantageously, as shown in FIG. 3, an assembly of at least one element of the buoy is arranged in a volume V surrounding the projecting container 17 when the buoy is in the storage configuration, in which the gas is confined in the cartridge 11.

This element is arranged in the receptacle 4 when the buoy is in the storage configuration. In other words, the tubular volume is surrounded by the receptacle 4 in the storage configuration. The projecting container 17 is, for example, surrounded by a cable winding 9.

Advantageously, as shown in FIG. 3, a tubular container 14 surrounds the projecting container 17 when the buoy is in the storage configuration. This tubular container 14 is housed in the receptacle 4 when the buoy is in the storage configuration.

The tubular container 14 is adjacent the transverse wall 71 on the axis z of the tube.

In the non-limiting example of FIG. 3, the projecting part 17 is surrounded by a winding surrounding the projecting part 17 of the cartridge 11 and by the cable container 14 surrounding the winding. A cable wound on itself such as to form a coil necessarily leaves a cylindrical volume free because the radius of curvature of the cable cannot go below a minimum radius of curvature corresponding to the radius of the free cylindrical volume. Thus, this configuration makes it possible to optimize the occupation of the volume of the container by occupying a volume that is naturally left free.

The cable container 14 has a globally tubular form. It is in the continuation of the casing 6 on the axis z.

The cable container 14 advantageously comprises an external surface (turned toward the receptacle 4 or the environment outside the buoy) which is globally cylindrical and preferably axisymmetrical, i.e. it has a circular cross section. Advantageously, the cable container 14 and the lateral wall 70 are coaxial in the storage configuration. The external surface of the cable container 14 has, for example, the same diameter as the casing 6, i.e. the same diameter as the external surface of the lateral wall 70 of the casing 6.

The cable container 14 advantageously lies against the casing 6 and a part of the depth unit 140. Thus, it makes it possible to limit the transmission of forces between the casing 6 and the part 140 via the cable during storage.

In a variant, the buoy 1 does not comprise a cable container 14.

Advantageously, at least one active functional element of the buoy is arranged in a tubular volume surrounding the projecting container 17 when the buoy is in the storage configuration in which the gas is confined in the cartridge 11. "Active functional element" is understood to mean an electrical or optical element, i.e. an element to be powered electrically or optically, transmitting electrical or optical energy, i.e. comprising at least one electrical wire or an optical fiber, or delivering, accumulating, transforming (such as, for example, an electric transformer) or modulating electrical or optical energy.

The cable forming the winding is, for example, an active element.

The cable 9 may make it possible to transmit information from the surface unit 5 toward the depth unit 8 and/or, conversely, is an active functional element. This is an electrocarrier cable.

The cable 9 comprises two parts, a first part 15 of which is attached to the depth unit 8 and of which the length is fixed, and a second part 16 of which comprises a tensioning device or elastic cable allowing insulation of the depth unit from the movements of the surface unit 5 upward and downward through the effect of the waves. In the storage configuration, these two units are separated by a partition 75 in the example of FIG. 3.

The surface unit 5 and the unit 8 are connected by connecting means comprising the cable.

Figure 4:
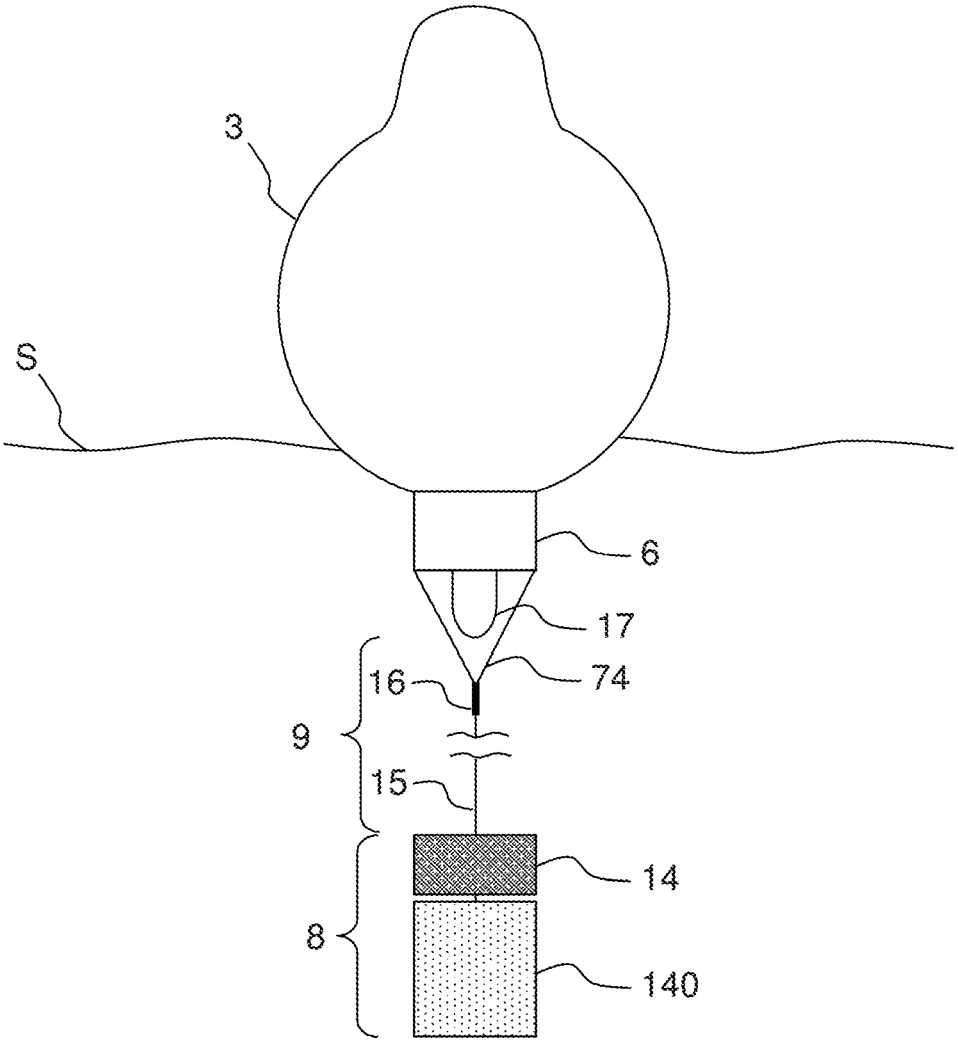

The cable 9 is, for example, connected to the surface unit 5 by means of wires 74 of the connecting means, for example three wires 74 of which only two are visible in FIG. 4, showing the buoy in the operational configuration. The wires 74 attached to the casing over the periphery of the casing 6 on the one hand and to the cable 9 on the other such as to ensure a force take-up at the center of the casing 6.

In a variant, the cable 9 is a passive element.

Instead and in place of the cable and/or in addition to the cable and/or an electrical transformer may be arranged in the tubular volume surrounding the projecting container 17. The transformer may surround the projecting container. A transformer generally has a ring or U form delimiting a free space in which the projecting container 17 may be inserted.

At least one hydrophone may be arranged in the tubular volume surrounding the projecting container 17. The hydrophone is, for example, supported by an arm designed to extend longitudinally substantially parallel to the axis of the tubular wall 70 when the buoy is in the storage configuration. This makes it possible to provide arms of significant length.

Advantageously, at least one arm is arranged in the tubular volume surrounding the projecting container 17. This arm extends, for example, longitudinally, substantially parallel to the axis z when the buoy is in the storage configuration, and the inclination thereof relative to the axis z varies between the storage configuration and the operational configuration.

In a variant, for example when the buoy is designed to be deployed from a submarine, a float, for example a foam float, may surround the projecting part 17. The foam float may have an annular form surrounding the projecting part. Thus, this float enables the buoy to rise naturally toward the surface when the buoy is deployed. The inflatable bag is not inflated until it is near the surface.

The float surrounds, for example completely surrounds, the projecting container 17 in the storage configuration.

Advantageously, the buoy 1 is configured such that the relative arrangement between the projecting container 17 and the element(s) arranged in the volume V surrounding the buoy is modified between the storage configuration and the operational configuration of the buoy 1.

Advantageously, the buoy is configured such that a front surface of a submerged part (a part in the water) of the projecting tank or of the surface unit when the buoy is in the operational configuration comprises a part of the projecting container 17. This configuration offers the advantage of limiting the drag of the surface unit.

Advantageously, a part of the depth unit 8 surrounds the projecting container 17 in the operational configuration. Thus, the projecting container penetrates a part of the depth unit 8 in the storage configuration of the buoy, which is counter intuitive but makes it possible to optimize the occupation of the space in the receptacle 4. In other words, at least one element of the buoy of the assembly of at least one element belongs to the depth unit.

In the particular example of the figures, the cable container 14 forms part of the depth unit 8 such that it separates from the surface unit upon inflation of the inflatable bag, i.e. when the surface unit rises toward the surface of the water. The cable 9 connecting the surface unit and the depth unit unwinds such as to release the cartridge.

In a variant, a part of the surface unit 5 is arranged in the tubular volume surrounding the projecting container 17. For example, the cable container 14 is integral with the casing 6 such as to be entrained by the casing toward the surface of the water when the casing 6 rises toward the surface of the water. This embodiment is less advantageous from the drag standpoint.

Advantageously, the projecting container 17 extends longitudinally parallel to the axis z. The projecting container 17 advantageously comprises a cylindrical part, the axis of which is parallel to the axis z and is, for example, coaxial with the casing 6 and/or the cable container 14 (in the storage configuration).

Advantageously, the gas cartridge 11 is oriented with its head at the top. In other words, the cartridge 11 is arranged such that the gas is expelled upward from the cartridge, on a vertical axis relative to the earth when the buoy is deployed and submerged in the water. When the buoy is deployed into the water, it adopts a natural orientation dependent on the position of its center of gravity and its center of hydrostatic thrust.

Thus, the cartridge is advantageously arranged such that the orifice 103 through which the gas escapes is located at the top of the cartridge 11 when the buoy is deployed and submerged when the buoy is in the storage configuration. This makes it possible to limit the likelihood of damage to the casing. Indeed, as the gas molecules are in the liquid state in the lower part of the cartridge and in the gaseous state in the upper part of the cartridge, upon release of the gas, when the cartridge is turned so that its head is at the bottom or when the cartridge is lying on its side there are risks of gas molecule droplets being projected through the effect of the pressure exerted by the gas on the liquid. These droplets, which are at a very low temperature (owing to the expansion of the gas), can exert mechanical stresses that may damage the casing. They may also damage the electronic circuits. The "head upward" arrangement of the cartridge makes it possible to limit this risk.

In the embodiment of the figures, the cartridge comprises a neck 121 delimiting the opening 103 closed by the film 101 in the storage configuration.

In the embodiment of the figures, the depth unit 8 comprises the cable container 14 and an operational unit 140. The operational unit comprises at least one active functional element of the antenna.

The operational unit is advantageously substantially cylindrical and of axis z in the storage configuration.

The invention claimed is:

1. A buoy comprising:

a surface unit comprising a sealed tank comprising an inflatable bag, a tubular lateral wall of axis z and a bottom, the tubular lateral wall and the bottom delimiting a volume referred to as an inner volume, the surface unit comprising at least one cartridge enclosing a compressed gas that can be released in such a way as to inflate the inflatable bag such that the inflatable bag functions as a float in an operational configuration of the buoy, the buoy comprising a depth unit connected to the surface unit by a cable, the depth unit and the surface unit being connected when the buoy is in a storage configuration, wherein the compressed gas is confined in the at least one cartridge, and separated when the buoy is in the operational configuration, the sealed tank comprising a projecting container protruding from the bottom and extending away from the inner volume, from the bottom, and a cable winding being arranged in a volume surrounding the projecting container when the buoy is in the storage configuration.

2. The buoy as claimed in claim 1, wherein a larger dimension of the projecting container perpendicularly to the axis z being less than a smaller dimension of the tubular lateral wall.

3. The buoy as claimed in claim 1, wherein the buoy is configured such that a front surface of a submerged part of the surface unit, when the buoy is in the operational configuration, comprises a part of the projecting container.

4. The buoy as claimed in claim 1, wherein the buoy is configured such that a front surface of a submerged part of the surface unit, when the buoy is in the operational configuration, comprises a part of the tubular lateral wall.

5. The buoy as claimed in claim 4, wherein the cable winding and the surface unit are inserted in one and a same receptacle when the buoy is in the storage configuration.

6. The buoy as claimed in claim 1, wherein a part of the depth unit surrounds a projecting element in the storage configuration.

7. The buoy as claimed in claim 1, wherein an active functional element is arranged in a volume surrounding the projecting container when the buoy is in the storage configuration.

8. The buoy as claimed in claim 1, wherein a tubular container surrounding the projecting container is arranged in a volume surrounding the projecting container when the buoy is in the storage configuration.

9. The buoy as claimed in claim 1, comprising a single cartridge.

10. The buoy as claimed in claim 1, wherein the cartridge is arranged such that the compressed gas is expelled from the cartridge upward, when the compressed gas is released.

11. The buoy as claimed in claim 1, wherein the projecting container is a part of the cartridge.

12. The buoy as claimed in claim 1, wherein the buoy is arranged such that the cartridge comes into direct physical contact with water when the buoy is submerged in the water.

13. The buoy as claimed in claim 1, wherein an inner volume receives at least one of an electronic circuit, an electrical energy accumulator, and a system for releasing the compressed gas.

14. The buoy as claimed in claim 1, wherein the projecting container delimits a volume communicating with the inner volume when the buoy is in a storage configuration in which the compressed gas is confined in the cartridge.

15. The buoy as claimed in claim 14, wherein the volume delimited by the projecting container receives a part of at least one of an electronic circuit, an electrical energy accumulator, a system for releasing the buoy and the at least one cartridge.

16. The buoy as claimed in claim 1, comprising a radioelectric antenna, the radioelectric antenna being arranged such that the radioelectric antenna is brought above a surface of water when the inflatable bag functions as a float.

* * * * *